United States Patent [19]

Squibb

[11] Patent Number: 5,041,801

[45] Date of Patent: Aug. 20, 1991

[54] MAGNETRON TUNING SYSTEMS

[75] Inventor: Keith Squibb, Chelmsford, United Kingdom

[73] Assignee: EEV Limited, Chelsmford, United Kingdom

[21] Appl. No.: 424,101

[22] Filed: Oct. 20, 1989

[30] Foreign Application Priority Data

Oct. 24, 1988 [GB] United Kingdom ..... 8824839

[51] Int. Cl.[5] ..... H01J 25/00

[52] U.S. Cl. ..... 331/90; 315/39.51; 315/39.61

[58] Field of Search ..... 331/86, 90; 315/39.51, 315/39.53, 39.55, 39.61

[56] References Cited

U.S. PATENT DOCUMENTS 3,967,155 6/1976 Chavanat et al. ..... 331/90 X

FOREIGN PATENT DOCUMENTS 209219 1/1987 European Pat. Off. .
1022707 3/1966 United Kingdom .
1327275 8/1973 United Kingdom .
1508380 4/1978 United Kingdom .

*Primary Examiner*—Robert J. Pascal
*Attorney, Agent, or Firm*—Spencer & Frank

[57] ABSTRACT

A magnetron is tuned by a co-axial transmission line co-axial with the axis of the magnetron and a radial transmission line linking the co-axial line to a plurality of sampling points symmetrically positioned on the end of the magnetron. A fraction of the R.F. power in the magnetron passes into the transmission lines and vice versa, so by altering the resonant frequency of the transmission lines the frequency of the RF power in the magnetron can be controlled.

6 Claims, 4 Drawing Sheets

MAGNETRON TUNING SYSTEMS

BACKGROUND OF THE INVENTION

This invention relates to magnetron tuning systems for magnetrons having a closed end and a proscribed internal radius.

At present there are two knonw main ways of frequency tuning such anodes.

The first method is shown in FIGS. 1A and 1B. FIG. 1A shows a cross-section through one side of a magnetron 1 along the line Y—Y in FIG. 1B, while FIG. 1B shows a cross section along the lines X—X in FIG. 1A.

The magnetron 1 is formed by a cylindrical outer body 2 bearing a plurality of vanes 3 on its inner surface. The magnetron 1 has a closed end 4. The volume between the vanes 3 defines the interaction space of the magnetron 1 and thus the resonant frequency which is dependent on it. An internal radius 5 of the magnetron 1 is proscribed from housing a frequency tuning mechanism because it is filled by an on-axis assembly, such as a cathode support, and this proscribed section extends along the axis of the magnetron beyond the closed end 4. A conductive plunger 6 having a number of conductive arms 7 occupying the volume between the vanes 3 and in electrical contact with adjacent vanes is used to tune the magnetron 1.

This tuning is carried out by moving the plunger 6 axially along the magnetron 1, for example to the dotted position 8. This alters the length of the interaction space by short circuiting the vanes 3 and so alters the resonant frequency of the magnetron.

A first bellows arrangement 28 links the plunger 6 with the magnetron 1 and a second bellows arrangement 29 links the plunger 6, with an extension (not shown) of the magnetron 1. This double-bellows arrangement prevents movement of the plunger 6 due to atmospheric pressure changes.

A cylindrical extension member 30 of the plunger 6 bearing a screw thread on its outer surface is secured to the plunger 6. A second cylindrical member 31 bearing a screw thread on its inner surface is attached to the magnetron 1 by a bearing allowing it to rotate relative to the magnetron 1 but not allowing axial movement relative to the magnetron 1. The second cylindrical member 31 can be rotated relative to the magnetron 1 by an electric motor. This bearing and driving arrangement is omitted for clarity. The threaded surfaces of the two cylindrical members 30 and 31 co-operate such that when the second cylindrical member 31 rotates, the first cylindrical member 30 is moved axially relative to the magnetron 1.

The position of the plunger 6 can thus be altered by operation of the motor.

There are a number of disadavantages to this arrangement. When the length of the interaction space is altered the dynamic impedance of the magnetron 1 will alter and, as a result, the voltage and power of the magnetron 1 will alter. Therefore, in order to keep the magnetron 1 stable a feedback system controlling the power supply must be used in conjunction with the tuner. The interior of the magnetron 1 is very hot so thermal expansion and contraction of the plunger 6 after it has been pushed further into or out of the magnetron 1 will cause the resonant frequency of the magnetron 1 to alter with time, making further tuning necessary. Further, in order to resist the thermal stresses produced by the heat of the magnetron 1 the plunger 6 must be relatively massive and so any non-axial accelerations acting on the magnetron 1, due to vibration for example, will pull the plunger 6 off axis and this will alter the size of the interaction space and de-tune the magnetron 1.

A second method of tuning magnetrons is shown in FIG. 2 which shows a cross-section through a magnetron.

A magnetron is formed by a cylindrical outer body 2 bearing a plurality of vanes 3. A conductive pin 9 is electrically linked to a vane 3A adjacent to a first cavity 14. The conductive pin 9 passes through a hole 10 in the outer body 2 of the magnetron 1 and into a second cavity 11.

The second cavity 11 is formed by a conductive tube 12 and a conductive plunger 13.

When the plunger 13 is moved along the tube 12 the length, and thus the resonant frequency, of the second cavity 11 is altered. Since the second cavity 11 is linked to the first cavity 14 this alteration of the resonant frequency of the second cavity 11 will alter the resonant frequency of the first cavity 14.

This method of tuning has the disadvantage that the azimuthal symmetry of the magnetron 1 is destroyed, resulting in a reduction in the frequency stability of the magnetron 1.

Both of these methods have the drawback that they tune all modes simultaneously. This can be a problem because magnetrons resonate in a plurality of modes, each mode generally having a different frequency. Simultaneous tuning of all modes can result in modes at unwanted frequencies entering the output frequency band of the transmitting system fed by the magnetron and producing spurious extra signals.

BRIEF SUMMARY OF THE INVENTION

This invention provides a magnetron tuning system for use with a magnetron having a closed end and a proscribed volume projecting beyond the closed end along the axis of the magnetron, the tuning system comprising; a co-axial transmission line co-axial with the axis of the magnetron and surrounding the proscribed volume for at least a part of its length; a radial transmission line connecting the co-axial transmission line to a plurality of symetrically disposed sampling points on the end of the magnetron, and means to alter the resonant frequency of the transmission lines, arranged such that, in use, a portion of the radiation in the magnetron passes through the sampling points into the transmission lines and resonantes there and a portion of the radiation in the transmission lines passes back into the magnetron.

This allows the magnetron to be frequency tuned without altering its dynamic impedance or affecting its azimuthal symmetry.

It is preferred that where the tuning system is used with a magnetron containing a plurality of cavities, one sampling point is linked to each pair of cavities such that, in use, the samples of $\pi$ mode radiation from the magnetron sum constructively at the co-axial transmission line and samples of radiation in all other modes cancel at the co-axial transmission line. This gives the advantage that only the $\pi$ mode is tuned thereby avoiding any problems with other modes entering the output frequency band.

BRIEF DESCRIPTION OF THE DRAWING

A magnetron tuning system employing the invention will now be described with reference to the accompanying Figures in which.

Similar parts having the same reference numerals throughout.

DESCRIPTION OF THE PREFERRED EMBODIMENT

Figure 1A:
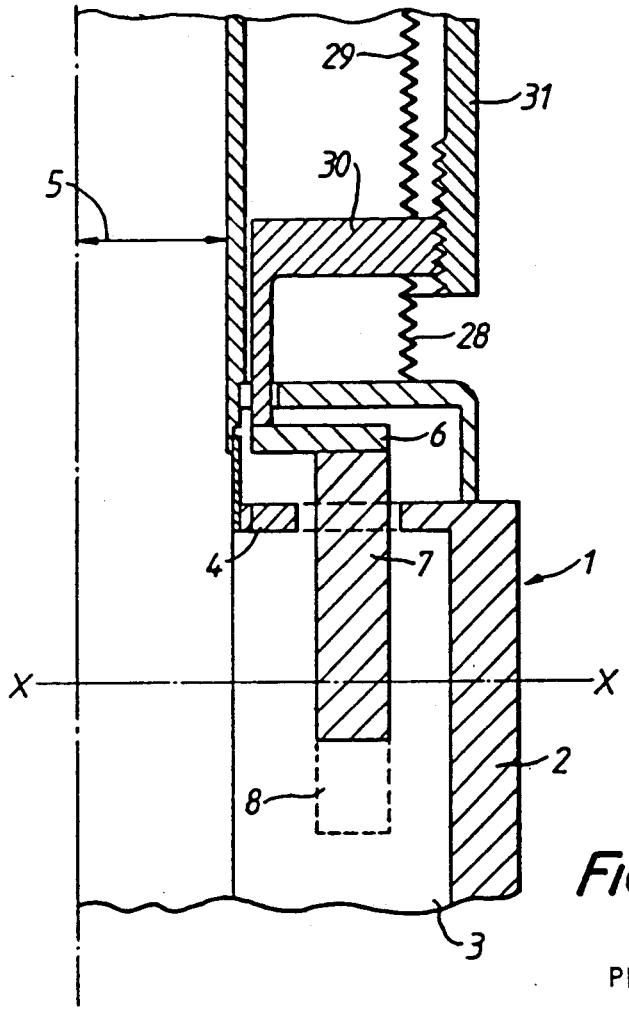
FIG. 1A. PRIOR ART
FIGS. 1A and 1B show cross sectional views of a prior art magnetron.
Figure 1B:
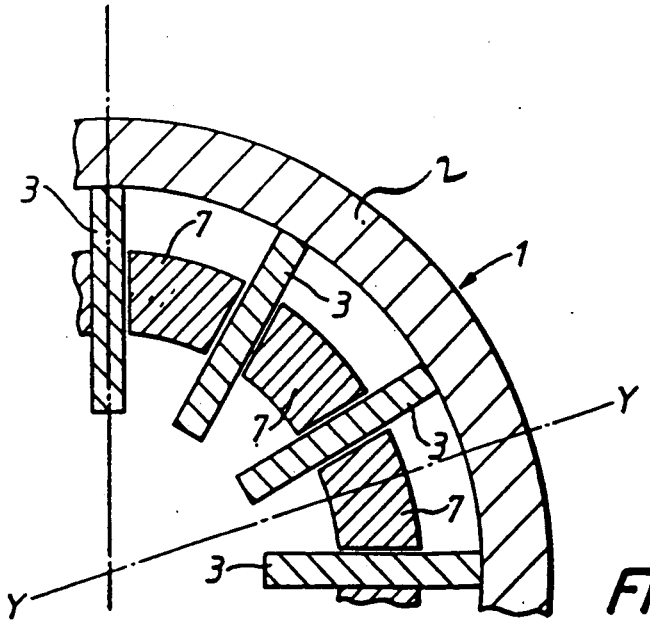
FIG. 1B. PRIOR ART
Figure 2:
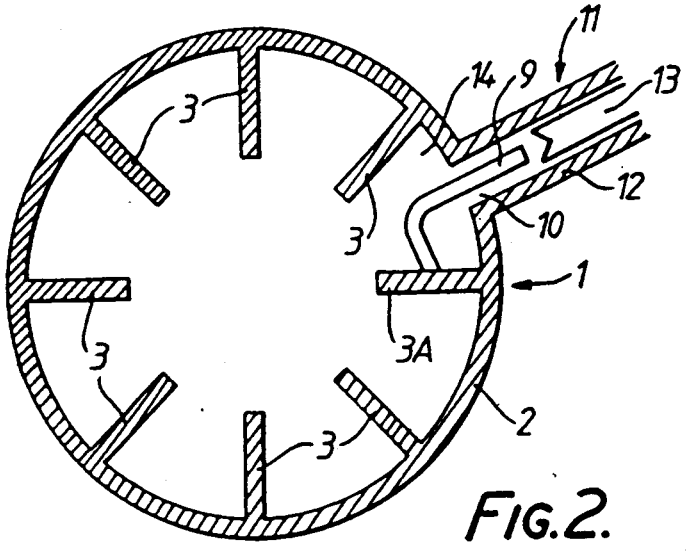
FIG. 2. PRIOR ART
FIG. 2 shows a cross sectional view of another prior art magnetron.
Figure 4A:
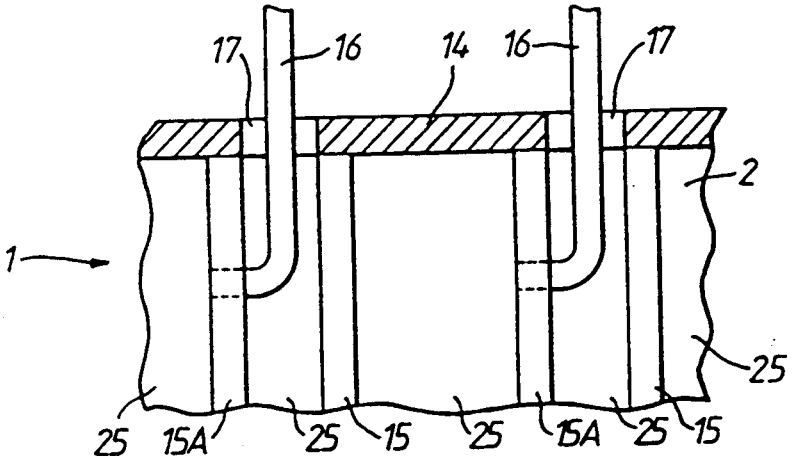
FIG. 4A shows a sectional view of a part of the tuning system of FIG. 3.
Figure 4B:
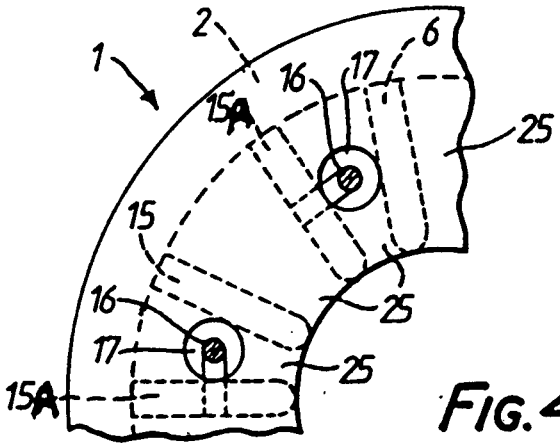
FIG. 4B shows another sectional view of the same part of the tuning system of FIG. 3.
Figure 3:
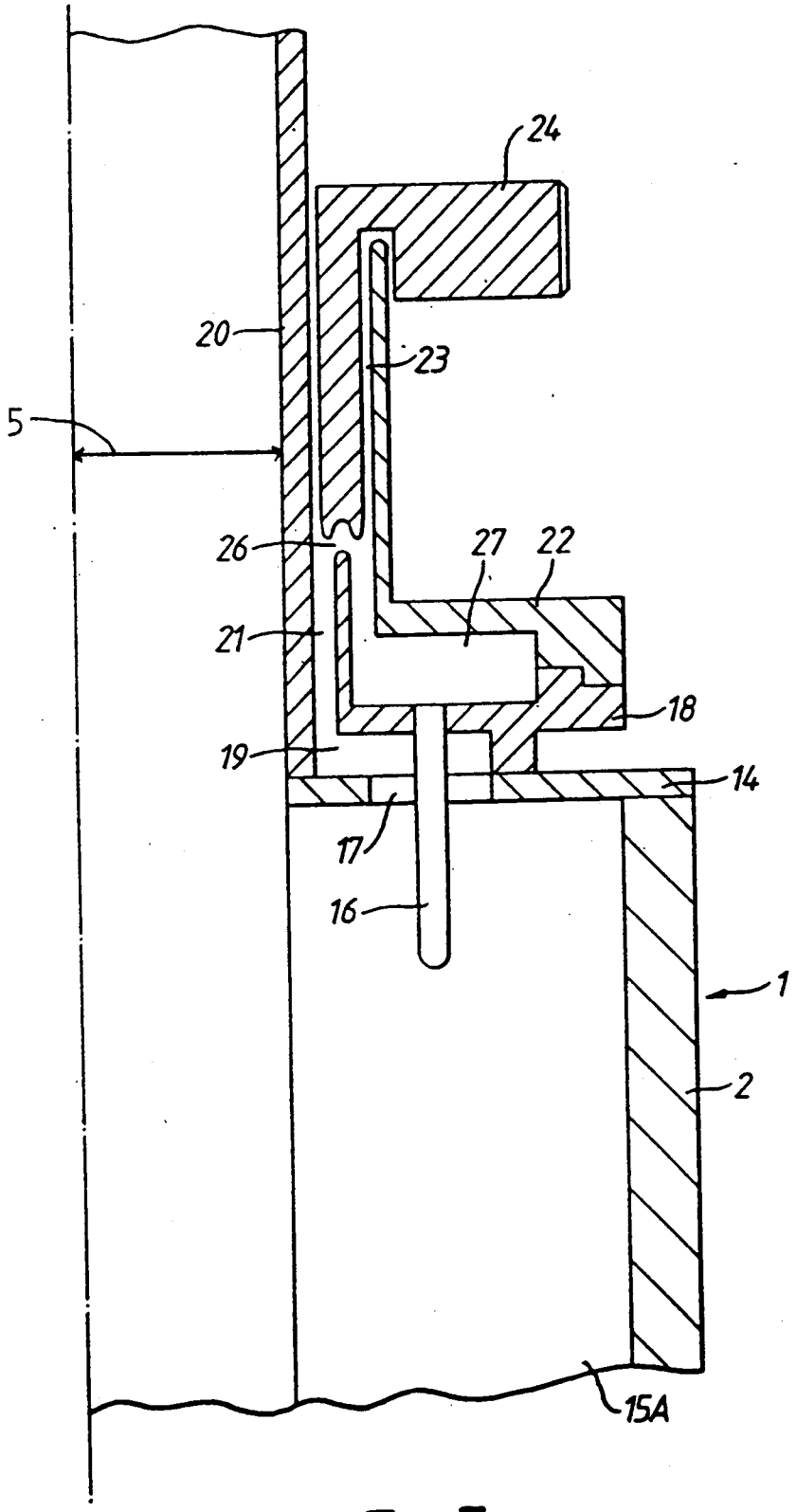
FIG. 3 shows a cross sectional view through a magnetron including a tuning system employing the invention.

Referring to FIGS. 3, 4A and 4B, a magnetron 1 is formed by an outer conductive cylindrical shell 2 and a plurality of conductive vanes 15. One end of the magnetron 1 is formed by a conductive plate 14.

The vanes 15 are arranged symmetrically around the outer shell 2, defining cavities 25 between them, alternate vanes 15A being electrically linked to conductive pins 16. The conductive pins 16 pass through holes 17 in the conductive plate 14 and are electrically linked to a first conductive element 18 opposite the holes 17. The first conductive element 18 co-operates with the conductive plate 14 to form a radial transmission line 19. A cylindrical tubular conductive member 20 surrounds the central axis of the magnetron, has a radius equal to the precluded internal radius 5, and co-operates with the first conductive element 18 to form a co-axial line 21.

A second conductive member 22 co-operates with the tubular conductive member 20 to define an annular parallel sided space 23 in which a conductive tubular plunger 24 can slide parallel to the axis of the magnetron 1.

The second conductive member 22 also co-operates with the first conductive member 18 to form a choke 27. The volume defined by the tubular conductive member 20, first conductive member 18, second conductive member 22 and plunger 24 will be referred to as the external volume.

An external bellows arrangement like that used in the prior art is used to prevent movement of the plunger 24 due to changes in atmospheric pressure, this is omitted for clarity.

In operation a sample of the radio frequency (R.F.) power from each of the cavities 25 containing a pin 16 is fed through one of the holes 17, each of which acts as a subresonant transmission line. These samples then travel radially inwards along the radial transmission line 19.

The samples of R.F. power are samples of all the modes of oscillation of the magnetron, and these samples combine in the radial transmission line 19. For the $\pi$ modes this combination is in phase, however for all other modes the combination is out of phase and the samples sum to zero. At the end of the radial transmission line 19 the combined R.F. power samples enter the annular space 21 which acts as a co-axial transmission line.

The R.F. power samples then travel along this co-axial transmission line until they reach the gap 26.

The combined lengths of the co-axial and radial transmission lines are slightly less than $\lambda/4$, where $\lambda$ is the wavelength of the $\pi$ mode radiation in the magnetron at the higest frequency of its desired tuning range.

As a result the R.F. power resonates along the co-axial and radial transmission lines between the gap 26 and the holes 17. The frequency of this resonation can be varied by altering the capacitance at the gap 26 by changing the separation of the first conductive member 18 and the plunger 24.

The separation of the plunger 24 from the first conductive member 18 is altered by sliding the plunger 24 axially along the magnetron by means of an electric motor driving a screw thread, the screw thread co-operating with threads on the plunger. Such a mechanism is described with reference to the prior art and is omitted from FIG. 3 for reasons of clarity.

The conductive plunger 24 is made $\lambda/4$ in length so that it acts as an isolation choke and prevents R.F. power from escaping from the system between the plunger 24 and tubular conductive member 20 and the second conductive member 23.

The screen choke 27 prevents the escape of R.F. power from the system.

Some of the R.F. power resonating in the external volume passes back through the holes 17 into the magnetron 1. As a result the resonant frequency of the $\pi$ mode in the magnetron 1 and the resonant frequency of the R.F. power in the external volume although different are related, so by altering the resonant frequency of the R.F. power in the external volume the resonant frequency of the mode in the magnetron 1 can be altered and thus the output frequency of the mode from the magnetron can be altered.

Figure 5A:
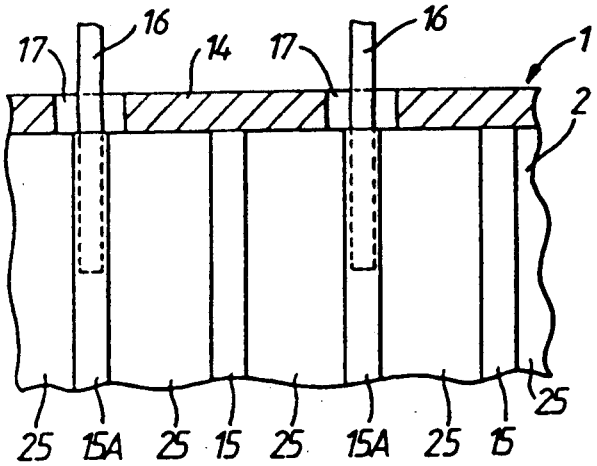
FIG. 5A shows a sectional view of an alternative arrangement of the part of the tuning system shown in FIG. 4A.
Figure 5B:
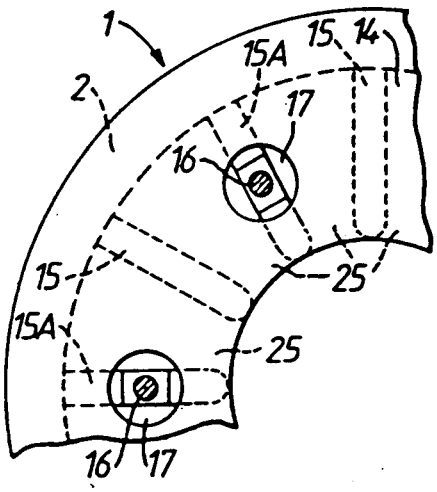
FIG. 5B shows another sectional view through the arrangement of FIG. 5A.

Referring to FIGS. 5A and 5B first alternative method of sampling the R.F. power in the magnetron is shown.

The vanes 15 are arranged symmetrically around the outer shell 2, defining cavities 25 and alternate vanes 15A are electrically linked to conductive pins 16 as before. The conductive pins 16 pass through holes 17 in the conductive plate 14 and are securred in slots in the vanes 15A. The pins 16 are in the plane of the vanes 15A.

Figure 6A:
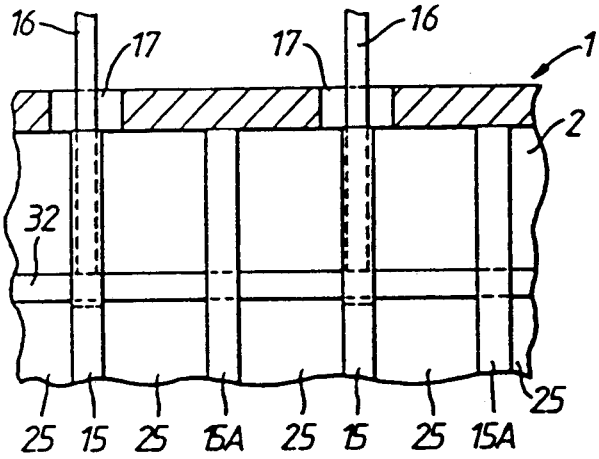
FIG. 6A shows a sectional view of an alternative arrangement of the part of the tuning systems shown in FIGS. 4A and 5A.
Figure 6B:
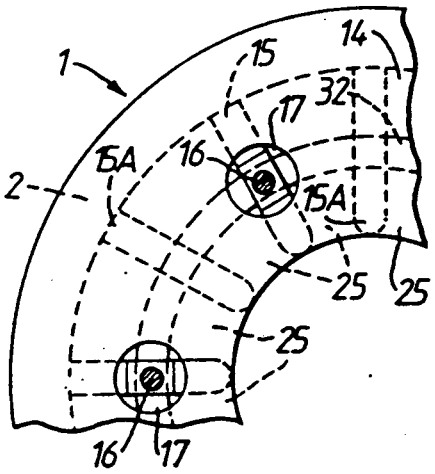
FIG. 6B shows another sectional view through the arrangement of FIG. 6A.
Figure 6C:
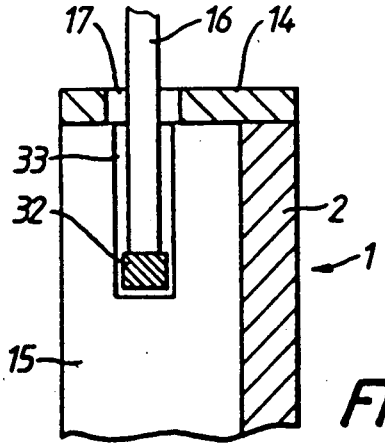
FIG. 6C shows a further sectional view through the arrangement of FIG. 6A.

Referring to FIGS. 6A, 6B and 6C a second alternative method of sampling the R.F. power in the magnetron is shown. The vanes 15 are arranged symmetrically around the outer shell 2 defining cavities 25. A conductive ring 32 passes around the magnetron 1 and is in electrical contact with alternative vanes 15A, whilst passing through the other set of alternate vanes 15 without contact.

Conductive pins 16 pass through the holes 17 in the conductive plate 14 and along slots 33 in the vanes 15 and are in electrical contact with the conductive ring 32. As a result, each pin is electrically linked to two loops back to back, each loop being formed by the pin 16, one of the conductive vanes 15A and the section of the ring 32 linking the two.

This invention could be carried out by constructions other than the described, for instance the combined lengths of the radial and coaxial transmission lines could be arranged to be slightly less than $\lambda/2$ and changes in inductance at the gap 26 could be used to alter the resonance frequency of the external volume.

The symmetrical pattern of vanes 15 need not be the equally spaced pattern described above, any symmetrical pattern could be used.

We claim:

1. A magnetron tuning system comprising; a co-axial transmission line coaxial with the axis of the magnetron; a radial transmission line connecting the co-axial transmission line to a plurality of symmetrically disposed sampling points on the end of the magnetron, and means to alter the resonant frequency of the transmission lines, arranged such that, in use, a portion of the radiation in the magnetron passes through the sampling points into the transmission lines and resonates there and a portion of the radiation in the transmission lines passes back into the magnetron.

2. A system as claimed in claim 1 in which the magnetron contains a plurality or cavities and one sampling point is linked to each pair of cavities such that, in use, the samples of $\pi$ mode radiation from the magnetron sum constructively at the co-axial transmission line and samples of radiation in all other modes cancel at the co-axial transmission line.

3. A system as claimed in claim 1 in which the combined lengths of the co-axial and radial transmission lines is slightly less than $\lambda/4$ and the means for altering the resonant frequency of the transmission lines alters the capacitance of the end of the co-axial line.

4. A system as claimed in claim 1 in which the end of the magnetron is closed by a conductive plate and the sampling points are holes through this plate.

5. A system as claimed in claim 4 in which conductive metal rods are electrically connected to the vanes between the cavities of the magnetron, pass through the holes in the conductive plate and are electrically connected to a wall of the radial transmission line.

6. A magnetron tuning system for use with a magnetron having a closed end and a proscribed volume projecting beyound the closed end along the axis of the magnetron, the tuning system comprising; a co-axial transmission line coaxial with the axis of the magnetron and surrounding the proscribed volume for at least a part of its length; a radial transmission line connecting the co-axial transmission line to a plurality of symmetrically disposed sampling points on the end of the magnetron, and means to alter the resonant frequency of the transmission lines, arranged such that, in use, a portion of the radiation in the magnetron passes through the sampling points into the transmission lines and resonates there and a portion of the radiation in the transmission lines passes back into the magnetron.

* * * * *